United States Patent [19]

Sergeant

[11] 4,387,610

[45] Jun. 14, 1983

[54] CHORDAL MECHANISM

[75] Inventor: Ronald G. Sergeant, Winston-Salem, N.C.

[73] Assignee: AMP Incorporated, Harrisburg, Pa.

[21] Appl. No.: 401,674

[22] Filed: Jul. 26, 1982

Related U.S. Application Data

[63] Continuation of Ser. No. 314,266, Oct. 23, 1982, abandoned, which is a continuation of Ser. No. 137,035, Apr. 3, 1980, abandoned.

[51] Int. Cl.[3] ..... B25B 7/00

[52] U.S. Cl. ..... 81/5.1 R; 81/43; 81/355; 81/129; 294/3; 294/99 R

[58] Field of Search ..... 81/3 R, 3.8, 5.1 R, 81/43, 53 R, 126, 128, 129, 355, 428 R; 24/255 R, 260; 294/3, 99 R; 339/103 R, 103 M

[56] References Cited

U.S. PATENT DOCUMENTS

| | | | |
|---|---|---|---|
| 736,964 | 8/1903 | Hanson . | |
| 2,430,794 | 11/1947 | White . | |
| 2,812,676 | 11/1957 | Brown . | |
| 3,177,693 | 4/1965 | Batcheller | 72/337 |
| 3,496,616 | 2/1970 | Vazquez | 81/5.1 R X |
| 3,525,107 | 8/1970 | Hays | 7/107 |
| 3,616,497 | 11/1971 | Esposito, Jr. | 24/255 R X |
| 3,628,824 | 12/1971 | Leuw et al. | 81/43 X |
| 3,630,068 | 12/1971 | Floyd, Jr. | 81/367 X |
| 3,733,656 | 5/1973 | Stalder | 24/255 R X |
| 3,906,957 | 9/1975 | Weston | 81/43 X |
| 4,023,450 | 5/1977 | Ygfors | 81/418 |
| 4,162,817 | 7/1979 | Briggs et al. | 24/255 R X |
| 4,192,204 | 3/1980 | Feldman | 81/43 |

FOREIGN PATENT DOCUMENTS

| | | | |
|---|---|---|---|
| 1475241 | 4/1969 | Fed. Rep. of Germany | 24/255 R |
| 2419818 | 11/1974 | Fed. Rep. of Germany . | |
| 1234375 | 6/1971 | United Kingdom . | |

*Primary Examiner*—James G. Smith

*Attorney, Agent, or Firm*—Gerald K. Kita

[57] ABSTRACT

The invention relates to a mechanism fabricated with elongated chords which undergo deflection to displace a force applying ram.

7 Claims, 10 Drawing Figures

CHORDAL MECHANISM

This is a continuation of application Ser. No. 314,266, filed 10-23-82;, now abandoned, in turn a continuation of application Ser. No. 137,035, filed 4-03-80, now abandoned.

FIELD OF THE INVENTION

The present invention relates to a force applying linkage or mechanism.

BACKGROUND OF THE PRIOR ART

A force applying tool is disclosed in U.S. Pat. 3,525,107. Pivotally linked handles are actuated by one hand to close together a pair of jaws.

Another tool is disclosed in U.S. Pat. No. 3,630,068. The tool handles are not directly pivotally connected. A linkage provides an improved mechanical advantage, when closing the jaws by actuating the handles. When the handles are released, the jaws are opened by a return spring.

SUMMARY OF THE INVENTION

The present invention relates to an improved mechanism which can be incorporated in a hand actuated, force applying tool or instrument to provide a tool stroke therefor. The mechanism is of unitary, molded or extruded, plastic construction, which eliminates assembly linkages and other separate parts. The mechanism may be fabricated integrally with various types of instruments. In an instrument having a fixed jaw and a moveable jaw, the mechanism may be used as a force multiplication device either for applying gripping pressure between the jaws or for forceably moving the jaws apart.

DETAILED DESCRIPTION

Figure 1:
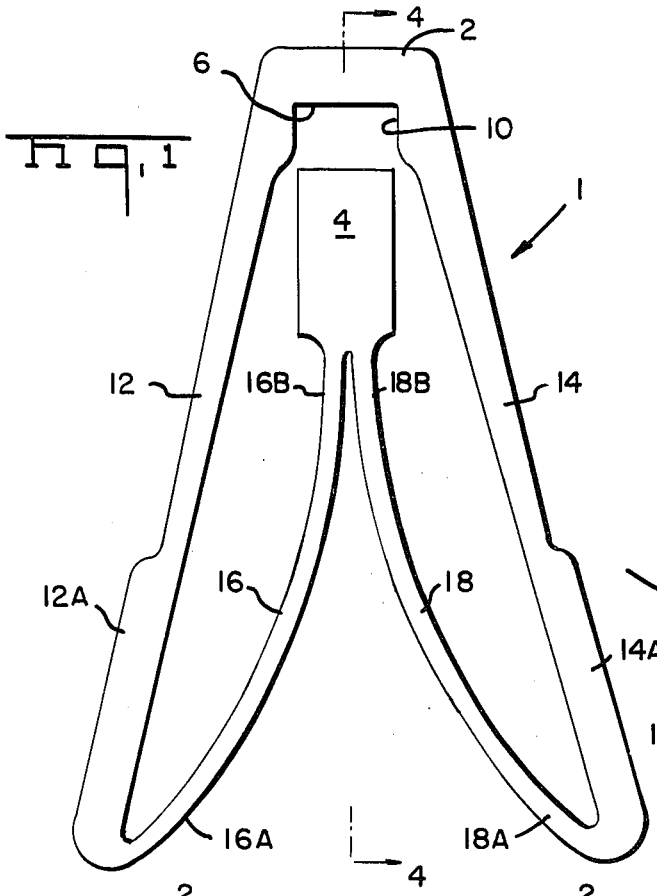
FIG. 1 is a front elevation of a force applying mechanism, according to the present invention, in an open position, incorporated into a simple instrument having a fixed jaw and a moveable jaw.

With more particular reference to FIG. 1, there is shown generally at 1, a force applying mechanism according to the present invention. The mechanism is incorporated into a simple instrument having a fixed jaw 2 and a moveable jaw 4. The fixed jaw 2 is provided with a shallow passageway 6 having parallel sidewalls 8 and 10 laterally supporting opposite sides of the moveable jaw 4 when the same is slidably displaced into and along the passageway in a manner to be described.

A first pair elongated chords 12 and 14 are joined at respective first ends to the fixed jaw 2 and flank opposite sides 8 and 10 of the passageway 6. The chords 12 and 14 diverge outwardly away from each other in directions along their lengths toward respective thickened end portions 12A and 14A. The moveable jaw is integral with a second pair of elongated chords 16 and 8 having first end portions 16A and 18A joined integrally with respective first chord end portions 12A and 14A. The chords 16 and 18 are slightly arcuate along their lengths with their convex surfaces facing each other. The chords converge toward each other, with their second end portions 16B and 18B being laterally adjacent to each other and joined integrally with the moveable jaw 4.

Figure 2:
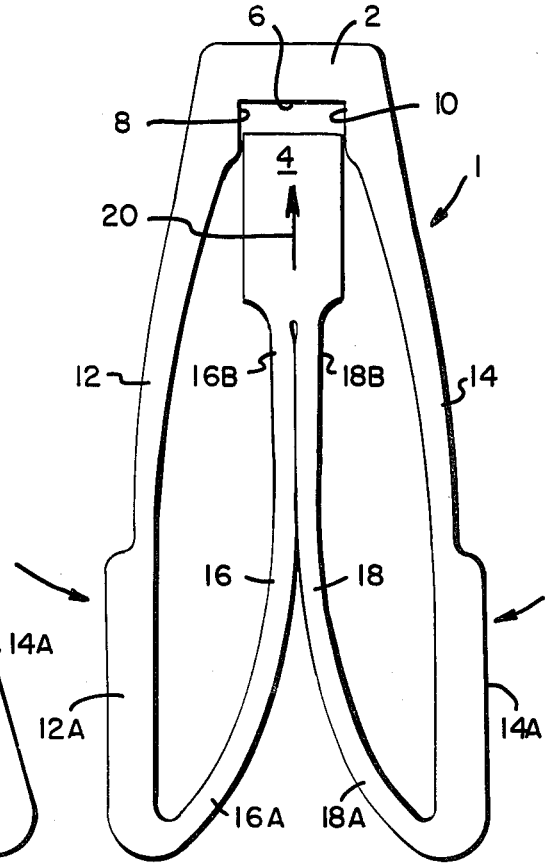
FIG. 2 is a view similar to FIG. 1 illustrating displacement of the moveable jaw upon actuation of the mechanism to a closed position.

FIG. 2 illustrates operation of the force applying mechanism. The outer chords 12 and 14 are pivoted toward each other, for example, by an operator grasping the thickened portions 12A and 14A, using the same as handles to close the same toward each other. As the chords 12 and 14 converge toward each other the adjacent chords 16 and 18 are displaced progressively toward each other, and become supported against each other, progressively along their lengths, beginning at the end portions 16B and 18B and progressing toward the opposite ends 16A and 18A. Additionally, the oversely curved surfaces of the chords 16 and 18 become flattened and straightened against each other. As a result of the described actuation, the moveable jaw 4 is cause to displace in the direction of the arrow 20 toward the fixed jaw 2. The jaw 4 will at least partially enter the passageway 6 so that the sides 8 and 10 of the passageway provide a track laterally supporting the jaw 4. Additional lateral support is provided by the chords 16 and 18 being supported against each other.

Accordingly, all the aforementioned elongated chords undergo deflection to provide a tool stroke for the moveable jaw 4. As a further advantage, the mechanism provides an inherent "quick take up" action, so called, because movement of the mechanism produces a correspondingly displacement of the jaw 4, toward and into registration with a workpiece placed between the jaws 2 and 4, until completion of the tool stroke generates the desired work performing force to be applied to the workpiece.

Figure 5:
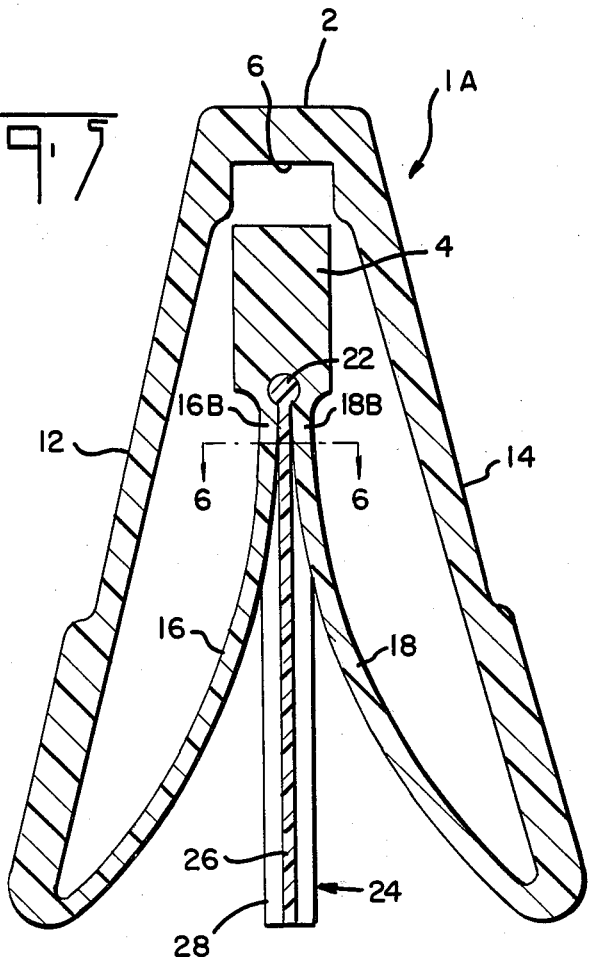
FIG. 5 is a front elevation in section of another preferred embodiment incorporating the mechanism shown in FIG. 1 in combination with an auxiliary rail.
Figure 6:
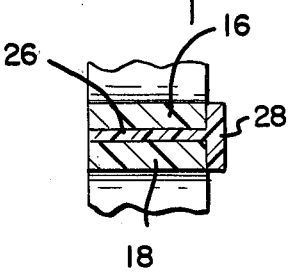
FIG. 6 is an enlarged fragmentary section taken along the lines 6—6 of FIG. 5.

FIG. 5 illustrates a mechanism 1A similar in all respects to the mechanism 1 with like numbers in the figures representing like parts. The mechanism is fabricated with a cylindrical socket 22 in the jaw 4 and communicating with the initially available space between the chords 16 and 18. The rail portion 26 is provided with a cylindrical shaft 26A which is slidably interfitted with the socket 22. The rail 26 is braced by a flange portion 28, providing the member 24 with a T-shaped cross section as shown in FIG. 6. When the mechanism 1A is actuated in a manner similar in respect to the mechanism 1, the rail portion 26 engages and supports the chords progressively along their lengths as the outer chords 12 and 14 are progressively pivoted toward each other. Further, the chords 16 and 18 progressively flatten along their lengths against the rail portion 26 as the mechanism is actuated.

Figure 7:
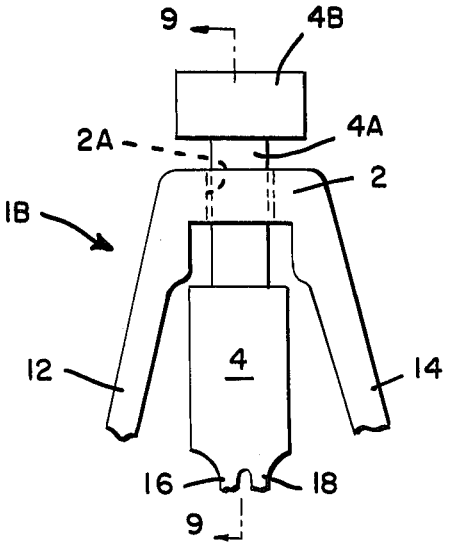
FIG. 7 is another preferred embodiment wherein instrument jaws are forced apart by actuation of the mechanism of FIG. 1.
Figure 8:
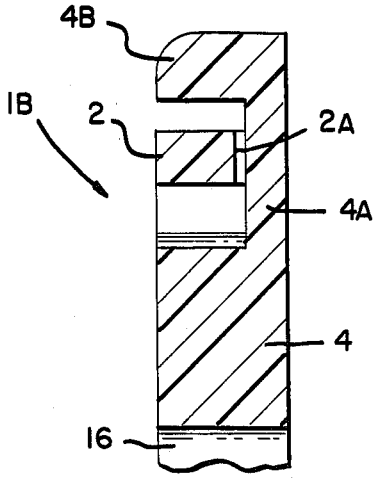
FIG. 8 is a fragmentary side elevation in section of the embodiment shown in FIG. 7.

FIGS. 7 and 8 illustrate another preferred embodiment 1B of the mechanism, similar in all respects to the mechanism of FIG. 1 except for the following. Again, like numerals in the figures represent like parts. The jaw 2 is provided with a channel 2A therethrough. The jaw 4 is provided with an elongated stem 4A which slidable traverses along the channel 2A. The stem 4A is provided at the end thereof with an auxiliary jaw portion 4B. During actuation of the mechanism 1B the jaw 4 is displaced toward the jaw 2 while, simultaneously the auxiliary jaw portion 4B is displaced away from the jaw 2. The mechanism 1B is used as a force multiplication device applying gripping pressure between the jaws 4 and 2. Alternatively, the mechanism may be used as a force multiplication device for applying forces to forceably separate the jaws 4B and 2.

Figure 3:
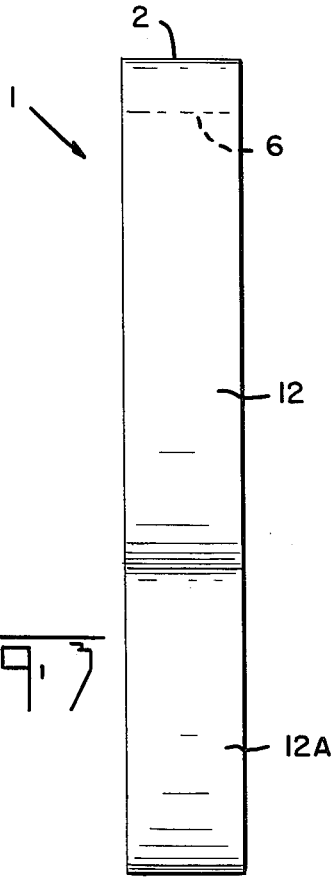
FIG. 3 is a side elevation of the device shown in FIG. 1.
Figure 4:
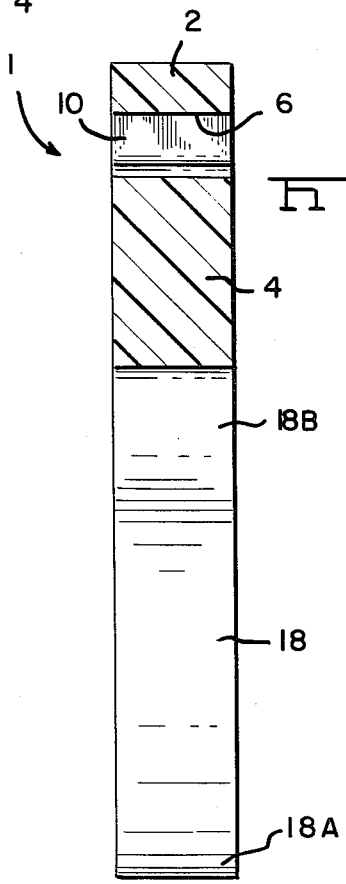
FIG. 4 is an elevation in section taken along the line 4—4 of FIG. 1.

In each of the embodiments thus far described, the mechanism is of unitary, molded or extruded, plastic construction. Preferrably the plastic is elastically deformable with a high yield strength. For example, the embodiment 1 of FIGS. 1-4 is suitable for molding in a straight draw mold. Also the embodiment may be fabricated as an extrusion having the cross-section illustrated in FIG. 1. Subsequently, the extrusion may be sliced into multiple mechanisms, with each slice having a thickness as illustrated in FIG. 3.

The embodiment shown in FIGS. 5 and 6 also may be molded or extruded. However, the rail 24 is fabricated separately from the remainder of the mechanism and attached thereto with the shaft and socket connection as described. When the mechanism 1, 1A or 1B, is manually actuated, to a closed position, for example, as shown in FIG. 2, and then manually released, the inherent resilient spring or elastic memory properties of the plastic material will open the tool, thereby reversing the tool stroke. Therefore, the mechanism eliminates the need for a return mechanism such as that required by hand operated instruments of the prior art.

The inherent spring properties also allow repeated operation of the mechanism in a pumping manner or mode, to operate a pumping instrument.

Figure 9:
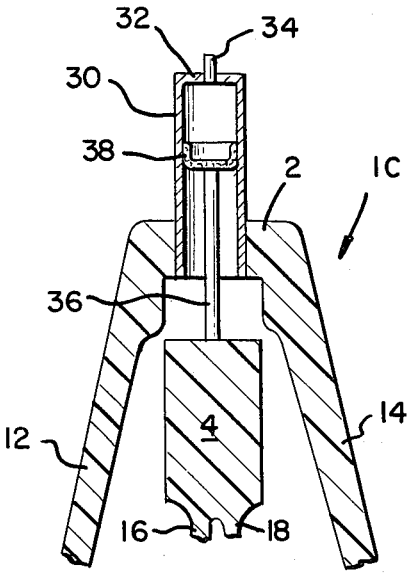
FIG. 9 is a fragmentary front elevation in section of a pumping instrument incorporating the mechanism as shown in FIG. 1.
Figure 10:
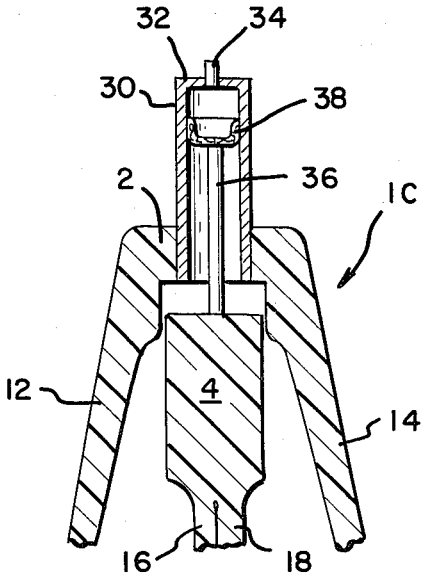
FIG. 10 is a view similar to FIG. 9 illustrating operation of the mechanism in a pumping mode.

FIGS. 9 and 10 illustrate another preferred embodiment 1C of the force applying mechanism incorporated into a pumping instrument. The mechanism 1C is similar in all respects to the mechanism 1 such that like numbers in the figures refer to like parts. The mechanism 1C incorporates a cylindrical piston casing 30 having an endwall 32 and an air port 34. The moveable jaw 4 has secured thereon a piston rod 36, the end of which is provided with a collapsable diaphragm piston 38. When the chords 12 and 14 are pivoted toward each other the piston 38 is forced to traverse along the casing 30 compressing the air inside the casing and forcing it outwardly of the port 34 under pressure. When the chords 12 and 14 are manually released the mechanism will automatically open, retracting the piston 38 from its position shown in FIG. 10 to its position shown in FIG. 9. Repeated closing and opening of the instrument will provide a desired pumping operation.

The resilient properties of the material also allow the mechanism 1 to operate also as a reciprocating mechanism which does not require tool jaws. One such mechanism is a shock absorber. The chords are closed toward each other in response to an applied energy or force to be cushioned or absorbed. During closure the outer chords resiliently stretch in tension and absorb some of the applied energy or force. The chords when fully closed then provide a resilient cushion for any residual energy or force in excess of the absorbed energy or force. When the applied energy or force is dissipated or removed, the mechanism will open in readiness for a repeated, shock absorbing operation. The mechanism appearance may be the same as in the previous embodiments, but without regard to a need for jaws as in the previous embodiments.

Although preferred embodiments of the present invention are described in detail, other embodiments and modifications thereof which would be apparent to one having ordinary skill in the art are intended to be covered by the spirit and scope of the appended claims.

What is claimed is:

1. A force applying mechanism moulded in one piece of plastics material and comprising:

first and second jaw portions, a pair of elongate, first chords joined to said first jaw portion and diverging outwardly therefrom, and a pair of elongate, second chords having first end portions joined to respective first chords and second end portions joined to said second jaw portion, the second chords having flexible, convex portions which are brought progressively into supporting engagement with each other and flattened on pivotal movement of the first chords towards each other to close the jaw portions relatively together during application of a force, and said first jaw portion providing a track guiding said second jaw portion during closure of the jaw portions relatively together.

2. The structure as recited in claim 1, and further including:

a rail secured to said second jaw portion and interposed between said second chords and progressively supporting said flexible portions of said second chords pivotal movement of said first chords toward each other.

3. The structure as recited in claim 2, wherein, said first jaw portion provides a passageway receiving said second jaw portion, said track being provided by opposite walls of the passageway.

4. The structure as recited in claim 1 or claim 2 or claim 3, wherein, said first chords are flexible.

5. The structure as recited in claim 1 or claim 2 or claim 3, wherein, said first chords provide handles by which said mechanism is actuated to displace said moveable jaw portion.

6. A unitary force applying mechanism, comprising:

a fixed jaw portion, a moveable jaw portion constructed for displacement toward and away from said fixed jaw portion, a pair of elongated, first chords joined to said fixed jaw portion and diverging outwardly therefrom, and a pair of elongated, second chords having first end portions joined to respective first chords and converging toward each other with second end portions thereof joined to said moveable jaw portion, said second chords being supported against each other progressively along their lengths upon pivoting said first chords toward each other to displace said moveable jaw portion, and said fixed jaw portion includes a track reciprocatingly receiving said moveable jaw portion.

7. A force applying mechanism comprising:

first and second jaw portions, a pair of elongate, first chords integrally joined to said first jaw portion and diverging outwardly therefrom, and a pair of elongate, second chords having first end portions integrally joined to respective first chords and second end portions joined to said second jaw portion, the second chords having flexible, convex portions which are brought progressively into supporting engagement with each other and flattened on pivotal movement of the first chords towards each other to close the jaw portions relatively together during application of a force, said first jaw portion providing a track guiding said second jaw portion during closure of the jaw portions relatively together.

* * * * *